US007841583B1

(12) United States Patent
Kureck

(10) Patent No.: US 7,841,583 B1
(45) Date of Patent: Nov. 30, 2010

(54) SYSTEM AND METHOD FOR DETECTING A DISCONTINUITY IN A MECHANICAL DRIVE TRAIN

(75) Inventor: Aaron S. Kureck, Menomonee Falls, WI (US)

(73) Assignee: Magnetek, Inc., Menomonee Falls, WI (US)

( * ) Notice: Subject to any disclaimer, the term of this patent is extended or adjusted under 35 U.S.C. 154(b) by 372 days.

(21) Appl. No.: 11/585,671

(22) Filed: Oct. 24, 2006

Related U.S. Application Data

(60) Provisional application No. 60/729,668, filed on Oct. 24, 2005.

(51) Int. Cl.
*B66D 1/48* (2006.01)

(52) U.S. Cl. ..... 254/267; 254/275

(58) Field of Classification Search ..... 254/267, 254/274, 275, 276
See application file for complete search history.

(56) References Cited

U.S. PATENT DOCUMENTS

| | | | | |
|---|---|---|---|---|
| 4,175,727 | A | 11/1979 | Clarke | 254/173 |
| 4,177,973 | A | 12/1979 | Miller et al. | 254/173 |
| 4,493,479 | A | 1/1985 | Clark | 254/274 |
| 4,597,497 | A * | 7/1986 | Aberegg | 212/274 |
| 5,167,400 | A | 12/1992 | Gazel-Anthoine | 254/275 |
| 5,671,912 | A | 9/1997 | Langford et al. | 254/267 |
| 6,097,165 | A | 8/2000 | Herron | 318/372 |
| 6,517,171 | B2 * | 2/2003 | Oshiro et al. | 303/113.5 |
| 2001/0041958 | A1 * | 11/2001 | Oshiro et al. | 701/69 |
| 2005/0127749 | A1 * | 6/2005 | Hartmann et al. | 303/122 |

* cited by examiner

*Primary Examiner*—Emmanuel M Marcelo
(74) *Attorney, Agent, or Firm*—Waddey & Patterson, PC; Mark J. Patterson

(57) ABSTRACT

Two incremental shaft encoders are mounted on the two extreme ends of a mechanical drive train. The encoders generate data which is representative of the rotational speed of the drive train component proximate to where the encoder is mounted. The data from the encoders is communicated to a logic unit associated with operation of the drive train, such as a variable frequency motor drive (VFD). Software in the logic unit monitors and compares the speed of both encoders. An encoder resolution setting and a gear ratio are entered into the software parameters. If a difference in speeds (as monitored and indicated by the encoders) is greater than a preset value for a period longer than a preset time period, the logic unit displays an error message and a programmed action (such as motor shutdown and load braking) is executed.

32 Claims, 5 Drawing Sheets

SYSTEM AND METHOD FOR DETECTING A DISCONTINUITY IN A MECHANICAL DRIVE TRAIN

CROSS-REFERENCES TO RELATED APPLICATIONS

This application is a Non-Provisional Utility application which claims benefit of co-pending U.S. Patent Application Ser. No. 60/729,668 filed Oct. 24, 2005, entitled "System and Method for Detecting a Discontinuity in a Mechanical Drive Train" which is hereby incorporated by reference.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates to mechanical drive trains in which a motor is connected to a load through one or more rotating components, including drive shafts, couplings and gear boxes. More particularly, the present invention pertains to methods and devices used to detect discontinuities in a drive train caused by broken drive shafts, loose couplings, gear failures and the like.

Many machines employ rotating drive trains to transmit power from a motor to a load. Frequently, such drive trains include a connected sequence of different rotating components, including drive shafts, couplings and gear boxes. One example of such a machine is a lifting hoist. The drive train in the hoist will have an electric motor on one end, coupled to a brake drum on the other end. In many such applications, a component failure in the drive train can cause a catastrophic failure of the machine, such as a load drop, and present a threat to the safety of the persons using or working around the hoist. Accordingly, prompt detection of drive train discontinuities that can lead to such a failure is critical.

Attempts have been made in the prior art to monitor mechanical drive trains for discontinuities using a programmable logic controller and a custom ladder-logic style program tailored to meet the needs of the specific drive train. However, these systems require separate hardware and software input from the drive unit itself. A system which integrated the necessary components directly into the drive unit would therefore be more efficient and flexible for accurately detecting and responding to all discontinuities in a complex mechanical drive train.

BRIEF SUMMARY OF THE INVENTION

The purpose of this invention is to detect a speed deviation between two points in a rotating mechanical drive train in a machine, such as a lifting hoist. Two incremental shaft encoders are mounted on the two extreme ends of the drive train. The encoders generate data which is representative of the rotational speed of the drive train component proximate to where the encoder is mounted. The data from the encoders is communicated to a logic unit associated with operation of the drive train, such as a variable frequency motor drive (VFD). Software in the logic unit monitors and compares the speed of both encoders, accounting for variances in encoder resolution and gear ratio parameters. If a difference in speeds (as monitored and indicated by the encoders) is greater than a preset value for a period longer than a preset time period, the logic unit displays an error message and a programmed action (such as motor shutdown and load braking) is executed.

DETAILED DESCRIPTION OF THE INVENTION

Figure 1:
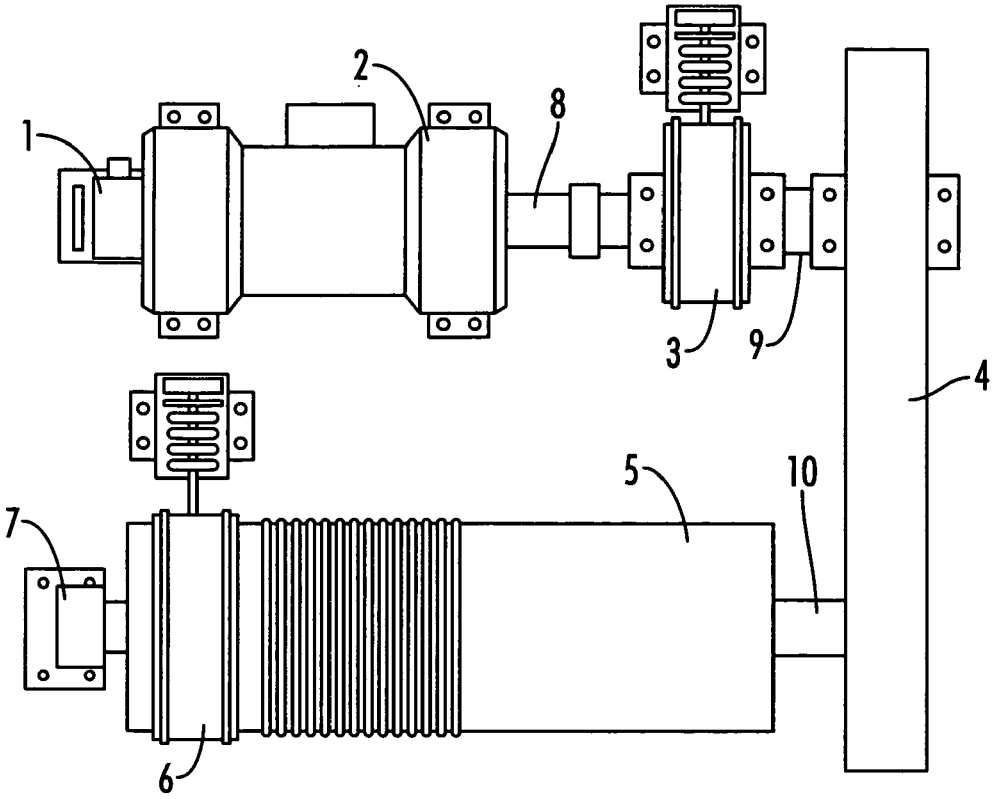
FIG. 1 is a top view of one embodiment of a single-hoist drive unit combined with a drive train discontinuity detection system in accordance with the present invention.
Figure 2:
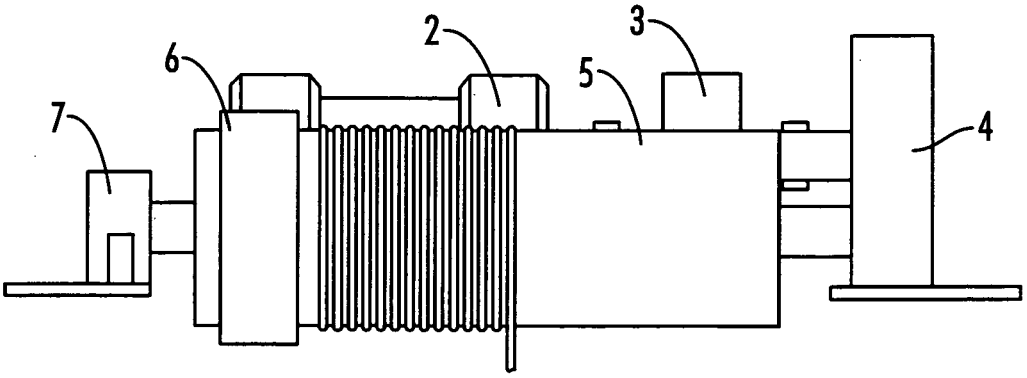
FIG. 2 is a side view of the single-hoist drive unit and discontinuity detection system of FIG. 1.

FIGS. 1 and 2 show a typical arrangement of mechanical drive train components for a single-drive lifting hoist in combination with one embodiment of a discontinuity detection system of the present invention. The shaft 8 of an electric hoist motor 2 is coupled to a first end of an electromechanical primary brake unit 3. The input shaft 9 of a gear reduction unit is 4 coupled to the opposite end of the primary brake unit 3. The output shaft 10 of the gear reduction unit 4 is coupled to a first end of the hoist drum 5. A secondary/emergency brake 6 is coupled to the opposite end of the hoist drum 5.

Figure 3:
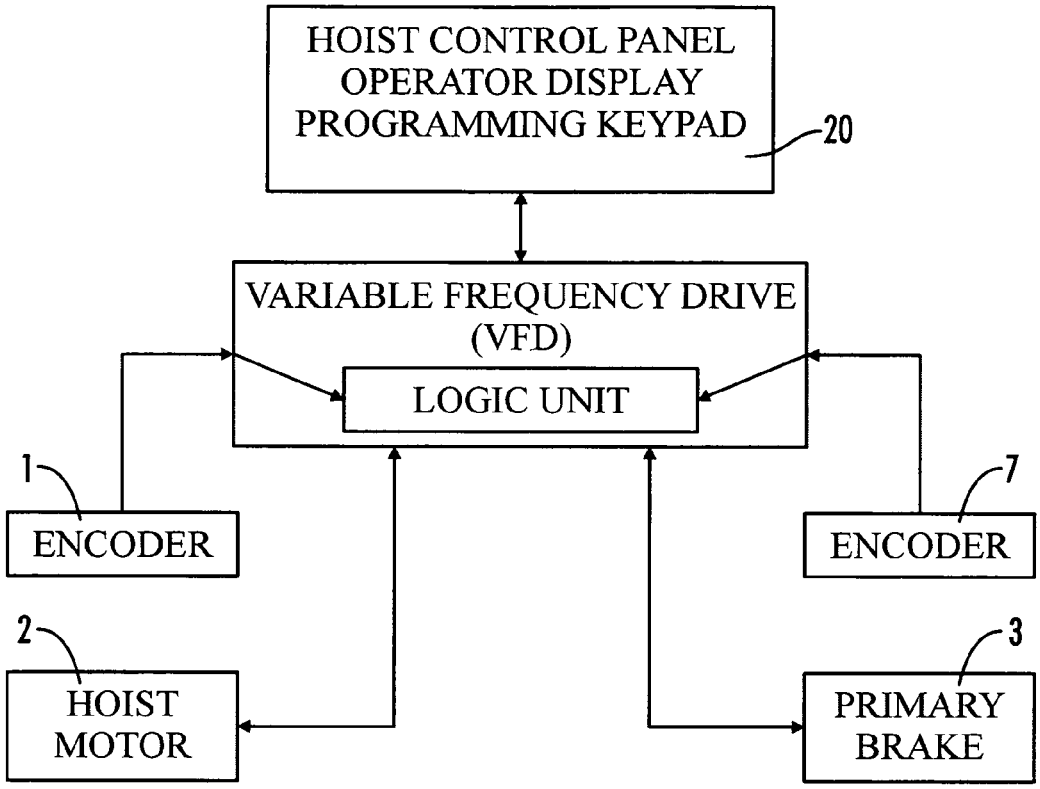
FIG. 3 is a block diagram of one embodiment of the discontinuity detection system of the present invention.
Figure 4:
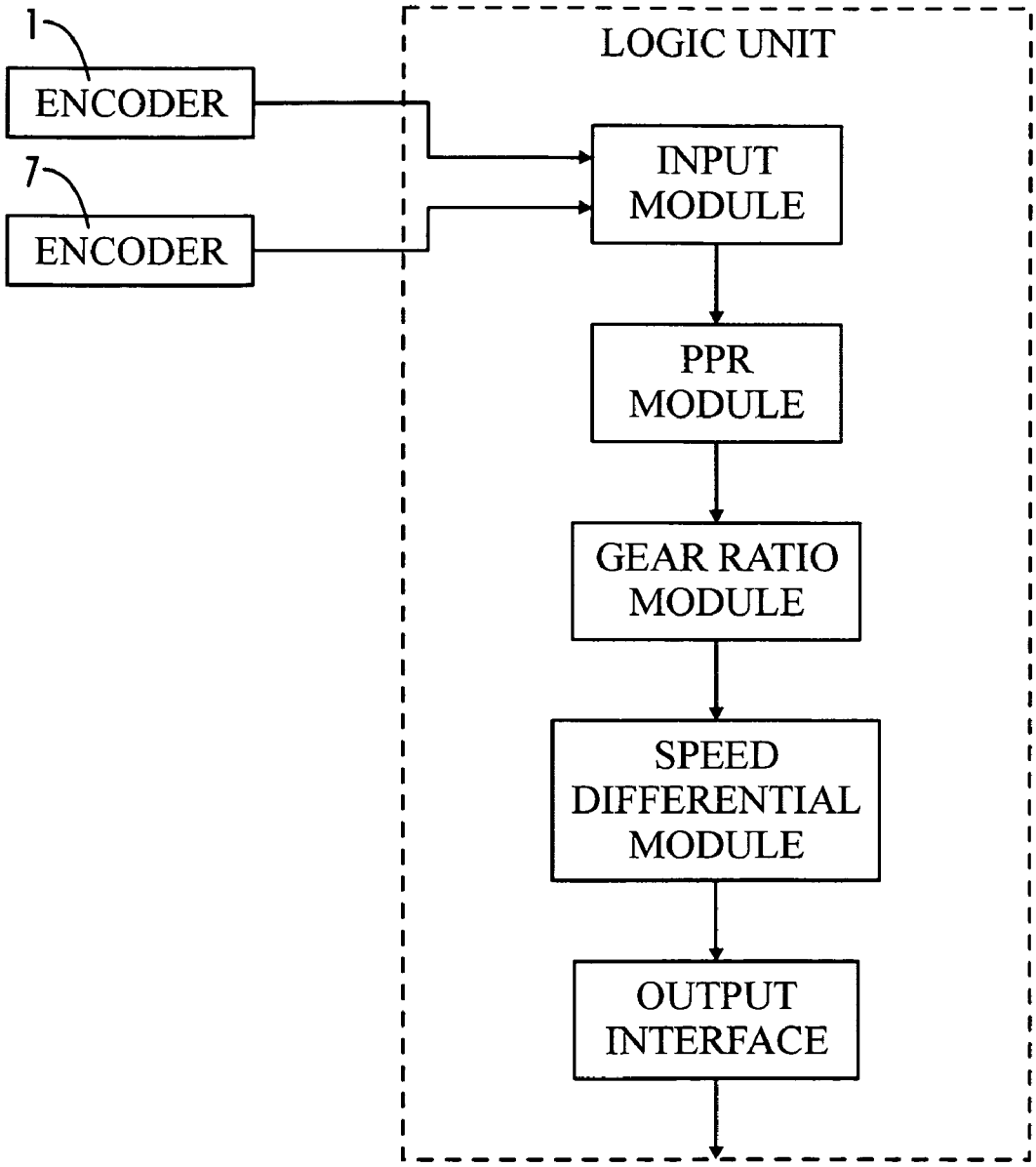
FIG. 4 is a block diagram of one embodiment of a logic unit used in the discontinuity detection system of the present invention.

Looking at FIG. 3, an electronic variable frequency motor drive (VFD) is used to control the operation of the hoist motor 2. The VFD includes at least one logic unit and corresponding software (FIG. 4) to provide for normal motor operation, including stopping, starting and reversing. In accordance with the present invention, the logic unit of the VFD further includes inputs and software to implement the discontinuity detection actions as described herein.

A first shaft encoder 1 (FIG. 1) is positioned proximate the shaft of high-speed motor 2 in a conventional manner such that the shaft encoder 1 will generate a motor shaft pulse train output that corresponds to the rotational speed of the motor shaft. A second shaft encoder 7 is positioned proximate a low-speed rotating component of the hoist drum 5 so that the second shaft encoder 7 will generate a hoist drum pulse train output that corresponds to the rotational speed of the hoist drum. An input module (FIG. 4) is provided on the VFD logic unit so that the pulse train outputs from the first and second shaft encoders 1, Tare received by the VFD logic unit.

Figure 6:
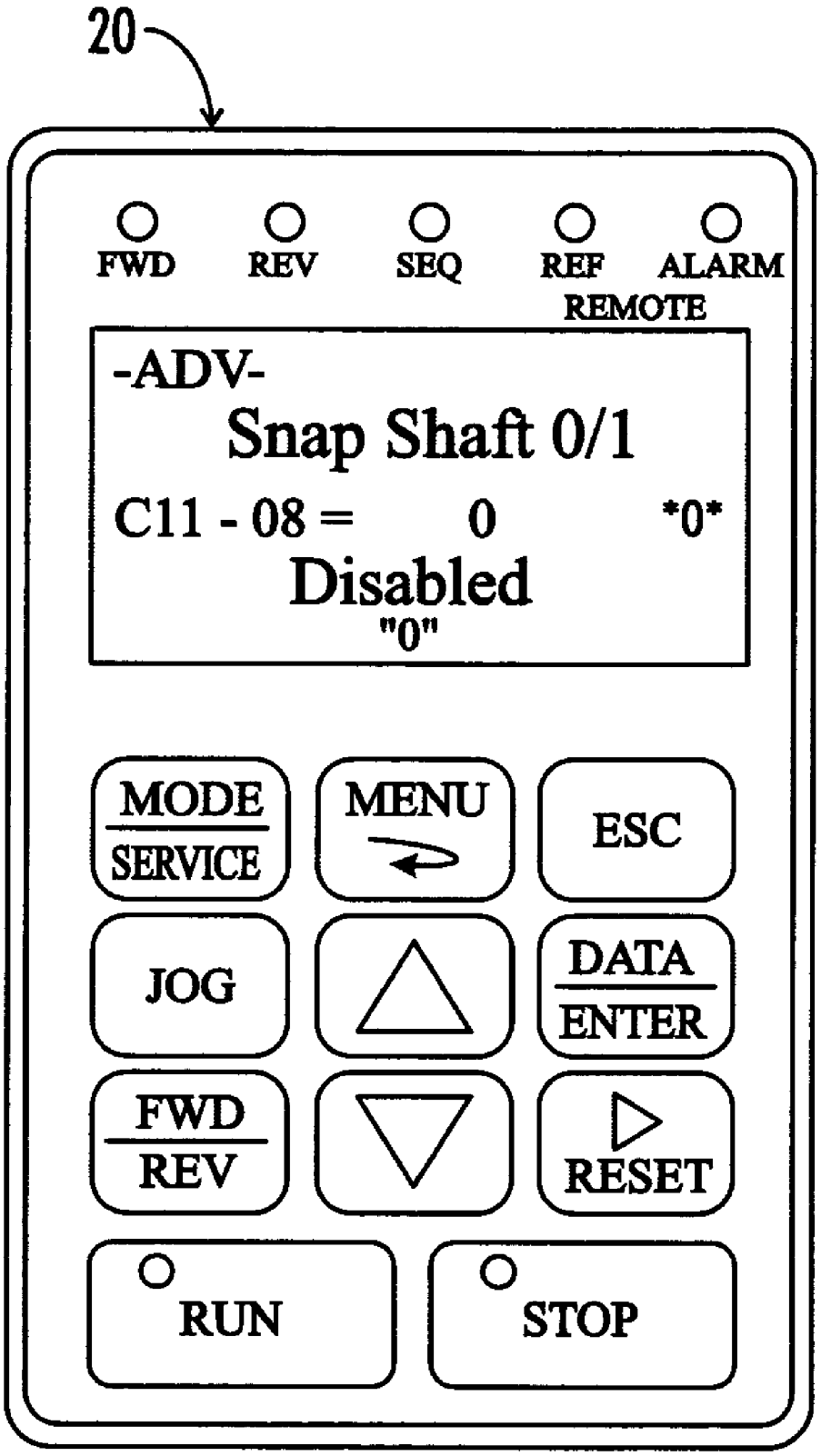
FIG. 6 is a front view of an operator control panel usable with the single-hoist drive unit and drive train discontinuity detection system of FIG. 1.

Preferably, the VFD logic unit includes sufficient hardware and software to provide programmable flexibility in processing the pulse train data from the encoders. One embodiment of the VFD logic unit is shown on FIG. 4 and will have programmable Pulse-per-Revolution (PPR) and electronic gear ratio functionality. PPR can be implemented in a PPR software module such that each encoder 1, 7 has a separately programmable PPR setting in the system for the number of pulses representing a single revolution. The encoder 7 measuring the rotational speed of the low-speed hoist drum 5 may need a higher a higher resolution PPR setting because the shaft is turning at a low speed. Similarly, the electronic gear ratio module allows a gear ratio numerator and gear ratio denominator to be separately programmed into the VFD logic unit. This allows the system to internally scale the data from the encoders 1, 7 so that the shafts at each end of the hoist drive train are normalized to a 1:1 ratio during proper operation. Programming can be implemented from a keypad on an hoist operator control panel 20 (FIGS. 3 and 6).

Upon processing the input data from the encoders 1, 7 to determine the rotational speeds, a speed differential module will compare the rotational speeds to each other. If the results of the comparison exceed a predetermined amount, for a predetermined amount of time which is programmed into a delay timer within the speed differential module, a signal is transmitted to an output interface. The output interface then implements a preprogrammed "discontinuity detected" action. Options for "discontinuity detected" actions include stopping the hoist motor 2, applying the primary hoist brake 3, displaying a "snap shaft" alert on the display of hoist operator panel 20 (FIG. 6) and closing relays on an output terminal block (not shown).

Accordingly, one embodiment of the system of this invention includes the programmable software parameters summarized in the table below. The programmable parameters can be set using the hoist operator panel 20 (FIG. 6).

| Parameter Name | Description |
|---|---|
| Discontinuity Detection 0/1 | Enables or Disables the Drive Train Discontinuity Detection:<br>0: Disabled<br>1: Enabled |
| Action At Discontinuity | Sets the action to take if Drive Train Discontinuity is detected:<br>0: Display on Keypad/Set Brake/Set Fault Output Relay<br>1: Display on Keypad/Set Brake/No Fault Output Relay<br>2: Display on Keypad Only |
| Delta Speed | Sets the threshold for the amount of speed difference between the two encoders (after the gear ratio and PPR calculations) at which the Delay Timer will begin. |
| Delay Time | Amount of time before the programmed Action will occur once the Delta Speed level has been reached. |
| Encoder 1 PPR | Sets the expected Pulse Per Revolution for Encoder 1. |
| Encoder 2 PPR | Sets the expected Pulse Per Revolution for Encoder 2. |
| Gear Ratio Numerator<br>Gear Ration Denominator | Sets the multiplier for the Gear Ratio Calculation. A setting of 10 in the numerator and 1 denominator will result in a 10:1 ratio setting. |

For a typical VFD used in a lifting hoist, the table below summarizes the parameter ranges that could be used:

| Parameter | Display | Function | Range | Initial Value |
|---|---|---|---|---|
| C11-08 | Snap Shaft 0/1<br>1 Disabled<br>0 Enabled | Determines whether Snap Shaft detection is enabled | 0-1 | 0 |
| C11-09 | Action at Snap<br>1 Brake/Fault out 0 Alarm only | Action taken at detection. A setting of 1 will set the brake and display a fault. With a setting of 0, the drive will continue to run. | 0-1 | 0 |

-continued

| Parameter | Display | Function | Range | Initial Value |
|---|---|---|---|---|
| C11-10 | SS Delta Speed | Difference in speeds of the two shafts normalized by the gear ratio. | 0-150 Hz | 1.0 Hz |
| C11-10 | SS Delay time | Gear backlash time in milliseconds | 0-2000 ms | 250 ms |
| C11-11 | SS Ratio Num | Gear ratio numerator | 1-10000 | 10000 |
| C11-12 | SS Ratio Den | Gear ratio denominator | 1-10000 | 10000 |
| U1-30 | SS Delta Speed | Actual speed difference between encoder channel 1 and channel 2 | 00.0-60.0 | —Hz |

Parameter U1-30 should be monitored during operation to obtain the exact speed difference in Hz between the two shafts. The low-speed shaft speed is normalized internally by multiplying the speed by the gear ratio. The value of C11-12 should be adjusted at system initialization such that U1-30 approaches 0.0.

Figure 5:
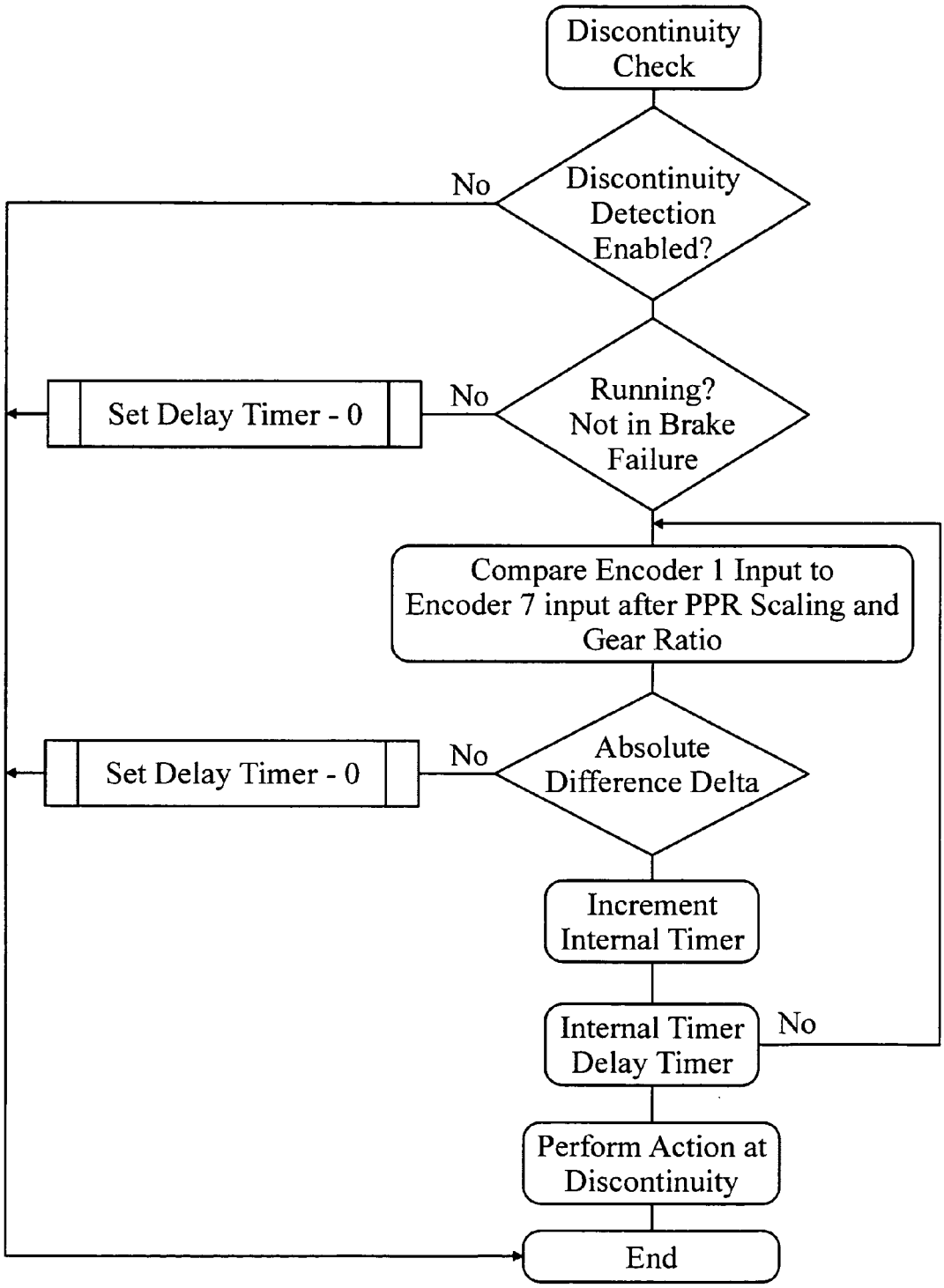
FIG. 5 is a flow chart of the steps of the method of the present invention.

FIG. 5 illustrates process steps implemented in one embodiment of the system of the present invention. The "discontinuity check" process is initiated at 5 ms intervals. The process first determines that discontinuity monitoring has been enabled in the system. Assuming that it has been enabled, the system then examines data provided to the VFD logic unit to determine if the hoist motor 2 is running and if one of the brakes 3, 6 is in a failure mode. If the hoist motor 2 is not running or if one of the brakes 3, 6 are in a failure mode, the delay timer is set to "0" and the process ends.

If the hoist motor 2 is running and the brakes 3, 6 are functioning properly, the data received from the first shaft encoder 1 is compared to the data received from the second shaft encoder 7, after the data is adjusted using the programmed PPR and electronic gear ratio parameters. If the results of the comparison exceed the allowable shaft speed delta programmed into the system, the process continues. Otherwise, the delay timer is set to "0" and the process ends.

When the process continues, an internal timer is incremented with the result compared to the delay timer. If the value of the internal timer is greater than the delay timer, a signal initiating a preprogrammed "discontinuity detected" action is generated. "Discontinuity detected" actions will typically include stopping the hoist motor, applying the hoist drum brake, displaying a "snap shaft" alert on the hoist operator panel 20 display and closing relays on an output terminal block.

If the value of the internal timer is not greater than the delay timer, the system will resume monitoring the encoder outputs to determine if the preprogrammed allowable shaft speed delta is still exceeded. In this way, a premature and unnecessary hoist shutdown is avoided. Otherwise, a false discontinuity could be signaled based merely on encoder data corresponding to shaft backlash or other normal conditions existing in the hoist drive train.

Thus, although there have been described particular embodiments of the present invention of a new and useful System and Method for Detecting a Discontinuity in a Mechanical Drive Train, it is not intended that such references be construed as limitations upon the scope of this invention except as set forth in the following claims.

What is claimed is:

1. A method of detecting a discontinuity in a mechanical drive train, the mechanical dive train including an electric motor, the method comprising the steps of:

controlling the electric motor with a variable frequency drive (VFD);

generating a first pulse train representative of a first rotational speed of a first drive train component positioned at a first end of the drive train;

generating a second pulse train representative of a second rotational speed of a second drive train component positioned at a second end of the drive train;

communicating the first and second pulse trains to the VFD;

processing the first pulse train within the VFD to determine the first rotational speed;

processing the second pulse train within the VFD to determine the second rotational speed;

comparing the first rotational speed with the second rotational speed; and if the first rotational speed differs from the second rotational speed by a predetermined amount, initiating a discontinuity detected action from the VFD.

2. The method of claim 1, further comprising selecting a first pulse-per-revolution (PPR) setting in the VFD for the first pulse train.

3. The method of claim 2, further comprising selecting a second PPR setting in the VFD for the second pulse train.

4. The method of claim 3, further comprising scaling in the VFD at least one of the first or second rotational speeds.

5. The method of claim 4, further comprising delaying initiation of the discontinuity detected action until the first rotational speed differs from the second rotational speed by the predetermined amount for a predetermined amount of time.

6. The method of claim 5, where the particular discontinuity detected action is user-selectable.

7. The method of claim 1, where the discontinuity detected action comprises one or more of displaying a visual error message, initializing braking action, and stopping the motor.

8. A system for detecting a discontinuity between first and a second rotating drive train components in a mechanical drive train, the mechanical drive train including an electric motor, the system comprising:

a variable frequency drive operably coupled to the motor;

a first sensor positioned proximate the first rotating drive train component, the first sensor operable to generate data representative of a first rotational speed of the first rotating drive train component;

a second sensor positioned proximate the second rotating drive train component, the second sensor operable to generate data representative of a second rotational speed of the second rotating drive train component; and the VFD further comprising a logic unit, the logic unit comprising hardware and software operable to:

receive the data generated by the first and second sensors, process the data, compare the first and second rotational speeds; and implement a discontinuity detected action after comparing the first and second rotational speeds.

9. The system of claim 8, where the first and second sensors comprise first and second incremental shaft encoders generating first and second pulse trains representative of the first and second rotational speeds, respectively.

10. The system of claim 9, the logic unit further comprising an input module operable to receive the generated first and second pulse trains.

11. The system of claim 10, the logic unit further comprising a pulse-per-revolution (PPR) module, the PPR module functional to accept a first selectable PPR setting for processing the first pulse train and determining the first rotational speed, and to accept a second selectable PPR setting for processing the second pulse train and determining the second rotational speed.

12. The system of claim 11, the logic unit further comprising an electronic gear ratio module for scaling at least one of the first or second rotational speeds.

13. The system of claim 12, the electronic gear ratio module functional to accept a selectable gear ratio numerator and a selectable gear ratio denominator, for scaling at least one of the first and second rotational speeds so as to normalize the first and second rotational speeds.

14. The system of claim 12, the logic unit further comprising a speed differential module for comparing the first rotational speed to the second rotational speed and initiating the discontinuity detected action when the first and second rotational speeds differ by a predetermined amount.

15. The system of claim 14, where the speed differential module further comprises a delay timer functional to delay the initiation of the discontinuity detected action until the first rotational speed differs from the second rotational speed by the predetermined amount for a predetermined amount of time.

16. The system of claim 14, the logic unit further comprising an output interface functional to implement the discontinuity detected action.

17. The system of claim 16, further comprising a user interface module operative to enable a user to view and manually program settings.

18. The system of claim 17, where the particular discontinuity detection action is selectable.

19. The system of claim 8, where the discontinuity detection action comprises one or more of displaying a visual error message, initializing braking action, stopping the motor, and triggering one or more fault output relays.

20. A mechanical drive train employed by a machine to transmit power from a first end of the mechanical drive train to a second end, the mechanical drive train comprising:

an electrical motor on the first end of the drive train;

at least one rotating component connected in sequence to the electrical motor;

a load positioned on the second end of the drive train opposite from the motor, so as to receive power transmitted by the motor along the sequence of connected rotating components;

a first sensor positioned proximate the first end of the drive train, the first sensor operable to generate data representative of a first rotational speed;

a second sensor positioned proximate the second end of the drive train, the second sensor operable to generate data representative of a second rotational speed;

a variable frequency motor drive (VFD), operably coupled to the motor; and the VFD further comprising a logic unit, the logic unit comprising hardware and software operable to:

receive the data generated by the first and second sensors, process the data, compare the first and second rotational speeds and implement a discontinuity detected action.

21. The mechanical drive train of claim 20, operable as part of a lifting hoist apparatus, the mechanical drive train further comprising:

a motor drive shaft having a first and second end, the first end connected to the electrical motor;

a first braking unit having a first and second end, the first end being operatively coupled to the second end of the motor drive shaft;

a gear reduction unit having a first and a second end;

an input shaft on the first end of the gear reduction unit, operatively coupled to the second end of the first brake unit;

an output shaft on the second end of the gear reduction unit;

the load comprising a hoist drum having a first and a second end, the first end of the hoist drum being coupled to the output shaft; and a second braking unit operatively coupled to the second end of the hoist drum.

22. The mechanical drive train of claim 20, where the first and second sensors comprise incremental shaft encoders generating a first and second pulse train representative of the first and second rotational speeds, respectively.

23. The apparatus of claim 22, the logic unit further comprising an input module operable to receive the generated first and second pulse train data.

24. The mechanical drive train of claim 23, the logic unit further comprising a pulse-per-revolution (PPR) module, the PPR module functional to accept a first selectable PPR setting for processing the first pulse train and determining the first rotational speed, and to accept a second selectable PPR setting for processing the second pulse train and determining the second rotational speed.

25. The mechanical drive train of claim 24, the logic unit further comprising an electronic gear ratio module operative to scale at least one of the first or second rotational speeds.

26. The mechanical drive train of claim 25, the electronic gear ratio module functional to accept a selectable gear ratio numerator and a selectable gear ratio denominator, for scaling at least one of the first and second rotational speeds so as to normalize the first and second rotational speeds.

27. The mechanical drive train of claim 25, the logic unit further comprising a speed differential module for comparing the first rotational speed to the second rotational speed and initiating the discontinuity detected action when the first and second rotational speeds differ by a predetermined amount.

28. The mechanical drive train of claim 27, where the speed differential module further comprises a delay timer operable to delay the initiation of the discontinuity detected action until the first rotational speed differs from the second rotational speed by the predetermined amount for a predetermined amount of time.

29. The mechanical drive train of claim 27, the logic unit further comprising an output interface operable to implement the discontinuity detected actions.

30. The mechanical drive train of claim 29, further comprising a user interface module enabling a user to view and manually select settings.

31. The mechanical drive train of claim 30, where the particular discontinuity detection action is selectable.

32. The mechanical drive train of claim 20, where the discontinuity detection action comprises one or more of displaying a visual error message, initializing braking action, discontinuing the motor drive immediately, or triggering one or more fault output relays.

* * * * *